United States Patent [19]

Stahlecker

[11] Patent Number: 4,606,186

[45] Date of Patent: Aug. 19, 1986

[54] AUXILIARY ROLLER DRIVE FOR OPEN-END FRICTION SPINNING MACHINE

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 662,186

[22] Filed: Oct. 18, 1984

[30] Foreign Application Priority Data

Oct. 26, 1983 [DE] Fed. Rep. of Germany ..... 3338834

[51] Int. Cl.[4] ..... D01H 7/882; D01H 11/00; D01H 13/02

[52] U.S. Cl. ..... 57/401; 57/103; 57/104; 57/263; 57/301

[58] Field of Search ..... 57/261, 262, 263, 400, 57/401, 301, 103–105

[56] References Cited

U.S. PATENT DOCUMENTS

| | | | |
|---|---|---|---|
| 3,987,610 | 10/1976 | Stahlecker et al. | 57/80 X |
| 4,110,960 | 9/1978 | Tsubata | 57/263 |
| 4,163,359 | 8/1979 | Honjo | 57/263 X |
| 4,168,601 | 9/1979 | Didek et al. | 57/401 |
| 4,222,225 | 9/1980 | Stahlecker et al. | 57/263 |
| 4,266,397 | 5/1981 | Dönmez et al. | 57/261 |
| 4,362,008 | 12/1982 | Parker et al. | 57/401 X |
| 4,380,892 | 4/1983 | Parker et al. | 57/263 X |
| 4,541,233 | 9/1985 | Raasch et al. | 57/401 X |

FOREIGN PATENT DOCUMENTS

| | | | |
|---|---|---|---|
| 35191 | 9/1981 | European Pat. Off. | 57/401 |
| 52412 | 5/1982 | European Pat. Off. . | |
| 2910814 | 10/1980 | Fed. Rep. of Germany | 57/263 |
| 3033047 | 4/1982 | Fed. Rep. of Germany | 57/400 |

*Primary Examiner*—Stuart S. Levy
*Assistant Examiner*—Joseph J. Hail, III
*Attorney, Agent, or Firm*—Barnes & Thornburg

[57] ABSTRACT

An open-end friction spinning machine is disclosed which has a large number of spinning units arranged next to one another, each containing two friction rollers arranged next to one another to form a wedge-shaped yarn forming gap. By means of a joint drive the friction rollers are driven in the same rotational direction. A servicing apparatus is provided which in each case can be applied to a spinning unit, said servicing apparatus having an auxiliary drive for the friction rollers, said auxiliary drive containing an auxiliary drive element that can be applied simultaneously to the shell surfaces of both rollers.

5 Claims, 10 Drawing Figures

23
22
20
18'
18
19
19'
25'
24'
21
A
25
24
12
1
26
29
10
5
11
9
28
27
31
33
32
36'
39'
34'
30
37'
38'
35'
15
34
36
17
39
35
E
F
38
C
D
37

56
53'
54'
55
57
58
18'
52'
21'
12
A
25'
50'
51'
26
1
10
29'
11
49'
47'
33
9
27
48'
31
36'
32
34'
30'
17
15
38'
35'
37'
C
D
E
F

AUXILIARY ROLLER DRIVE FOR OPEN-END FRICTION SPINNING MACHINE

BACKGROUND AND SUMMARY OF THE INVENTION

This invention relates to an open-end friction spinning machine having a large number of spinning units arranged next to one another, each containing two friction rollers arranged next to one another which, by means of a joint drive, are driven in the same rotational direction and which, with their shell/cover surfaces, form a wedge-shaped gap serving as the yarn forming region or point.

In the case of an open-end friction spinning machine, it is advantageous to drive all spinning units, at least on one machine side, by a joint drive, as this is known, for example, for a single unit (see European Patent EP-PS No. 52 412). When servicing work is carried out at a single spinning unit, it is in many cases necessary to interrupt the drive of the rollers of this spinning unit without disturbing the adjacent spinning points of the other spinning units. In this case, it is often necessary, during the servicing work, especially during a yarn piecing operation, to drive the rollers at rotating speeds that deviate from the normal spinning operational rotating speeds.

The invention is based on the objective of developing an open-end friction spinning machine of the initially mentioned type in such a way that it is possible to drive the rollers of a spinning unit at an arbitrarily adjustable speed that is not dependent on the operational drive for normal spinning operations.

This objective is achieved according to an important aspect of the invention by providing a servicing apparatus which can be selectively applied in each case to one spinning unit, said servicing apparatus having an auxiliary drive for the rollers containing an auxiliary driving element that can simultaneously be applied to the shell or cover surfaces of both rollers. By means of this arrangement of the invention, it is possible to drive the rollers of one single spinning unit at a desired speed independently of the normal spinning operational drive. Since the auxiliary drive is applied directly at the shell surfaces of the rollers, the drive can very sensitively adjust the desired speeds, since no transmission or similar means exist between the point of application of the auxiliary drive and the rollers.

According to a further aspect of preferred embodiments of the invention, it is provided that the auxiliary drive contains a joint driving element that runs simultaneously against the shell surfaces of both rollers. This also extensively simplifies the operational drive via the auxiliary servicing apparatus.

According to an advantageous development of the invention, it is provided that the servicing apparatus is equipped with means for interrupting the normal operational drive of the rollers by detaching the joint driving element from both rollers. Thus, it is avoided that the operational drive and the auxiliary drive affect the rollers at the same time.

According to another advantageous development of certain preferred embodiments of the invention, it is provided that each spinning unit is equipped with means for interrupting the drive of the rollers by detaching the joint driving element from both rollers. In the case of this development, it is provided that the spinning unit itself, for example, as a function of a yarn breakage, already interrupts the operational drive of the rollers, before the servicing apparatus becomes operative.

In order to provide an operational drive for the rollers that is as simple as possible and that also permits an interruption by simple means, a tangential belt is provided as the joint driving element which passes through in longitudinal direction of the spinning machine resting against the shell surfaces of both rollers of the respective spinning units, and which at each spinning unit, by means of a tension roll arranged in the plane of the wedge-shaped gap, is loaded in the direction of the shell surfaces of the rollers. In the case of this arrangement, it is ensured in a simple manner that both rollers that are driven in the same rotational direction are driven and loaded evenly by the tangential belt. In this case, the construction of the drive is very simple since only one tension roll is required. The result is that then the means for interrupting the drive can be constructed correspondingly simply since only the one tension roll and possibly also the tangential belt must be moved away from the rollers.

In a further development of the invention, at least one brake lining held by a spring is mounted at a lever holding the tension roll. This brake lining can be applied to the shell surface of a roller when the lever is adjusted to the inoperative position. Consequently, with the interruption of the operational drive, a braking of one of the rollers is caused, especially of the roller rotating into the wedge-shaped gap, which has the result that fiber or yarn residues located in the wedge-shaped gap after a yarn breakage can be removed easily therefrom.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
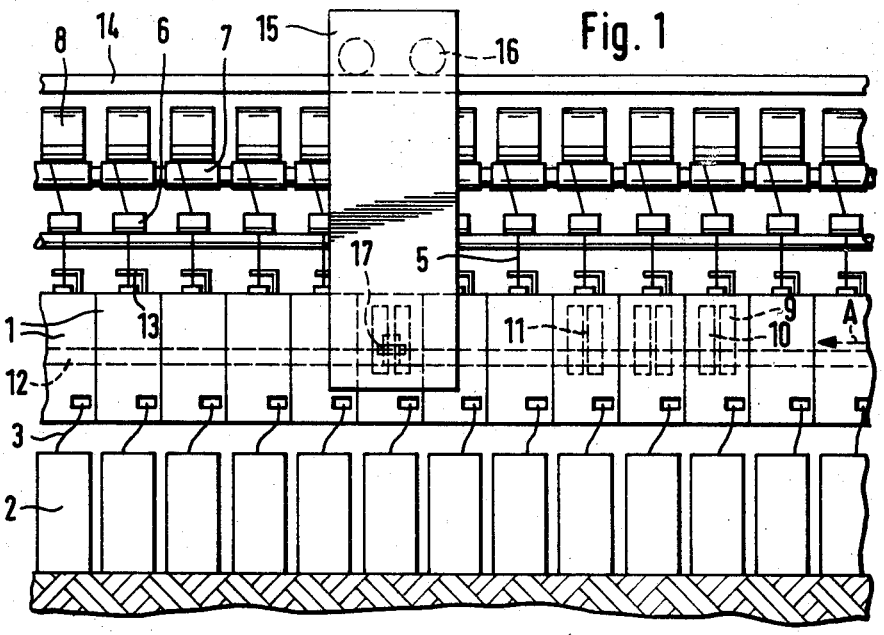
FIG. 1 is a partial front schematic view of an open-end friction spinning machine having a movable servicing apparatus, constructed in accordance with a preferred embodiment of the present invention.

In the following description and in the drawings the same reference numbers are used in the individual figures for components which correspond to one another with respect to function. In the normal spinning operational condition of the spinning unit, the reference numbers are used without any index. In the inoperative condition, where the operational drive is interrupted, and an auxiliary drive is assigned, the reference numbers of those components whose position has changed are primed or provided with an apostrophe ('). Components of the auxiliary drive which have not yet replaced the operational drive, but have already changed their position in view of the application of an auxiliary drive, have reference numbers that are double primed or provided with two apostrophes (").

The open-end friction spinning machine according to FIG. 1 has a large number of spinning units 1 arranged next to one another. A sliver 3 to be spun is fed to each spinning unit 1 from a spinning can 2. The yarn 5 spun in the respective spinning unit 1 is withdrawn by means of a withdrawal device 6, and fed to a wind-up spool 8 which is driven by a grooved drum 7.

Each spinning unit 1 has two friction rollers 9 and 10 that are arranged next to one another and together form a wedge-shaped gap 11 serving as the yarn forming region or point. In FIG. 1, the respective rollers 9 and 10 are depicted in the drawing only in four spinning units 1, it being understood that each spinning unit includes such rollers. All rollers 9 and 10 of all spinning units 1 of one side or the machine are driven in the same rotational direction by means of a tangential belt 12 running through the machine in the direction of the arrow A.

Between the rollers 9 and 10, on the one hand, and the withdrawal device 6, on the other hand, each spun yarn 5 is assigned a yarn detector or feeler 13 which is coupled with a yarn monitor which is not shown and which, in the case of a yarn breakage, interrupts the feeding of the sliver 3 at the respective spinning unit.

A rail 14 is arranged along the open-end friction spinning machine above the spinning units 1 and a servicing apparatus 15 is movably guided on said rail 14 by means of runners or rollers 16. This servicing apparatus is provided with an auxiliary drive that is developed as a friction drive 17, the detailed operation of which is described below.

Figure 2:
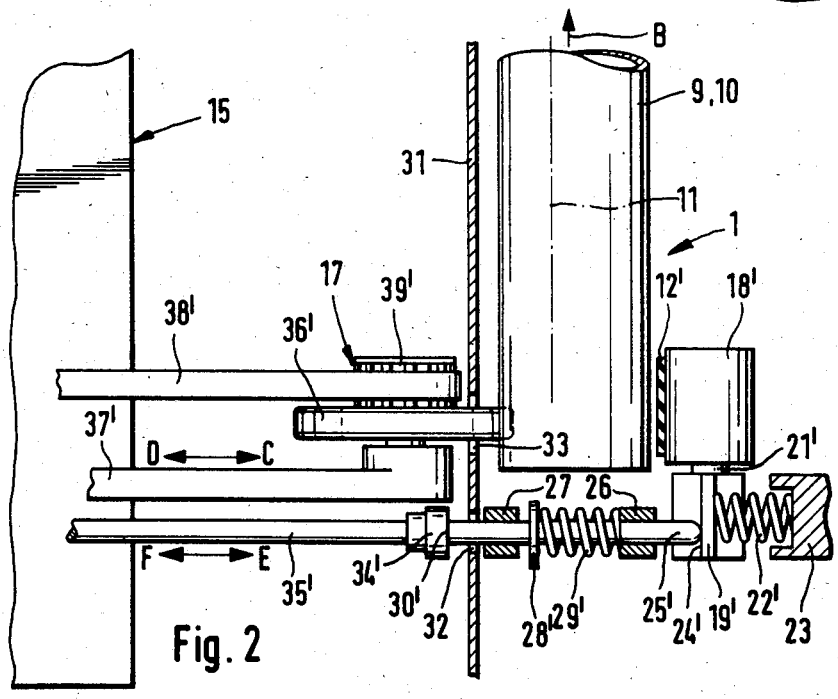
FIG. 2 is an enlarged, partial sectional schematic lateral view of a spinning unit of FIG. 1, illustrating the parts with the operational drive interrupted and an auxiliary roller drive of the movable servicing apparatus applied to the rollers.
Figure 3:
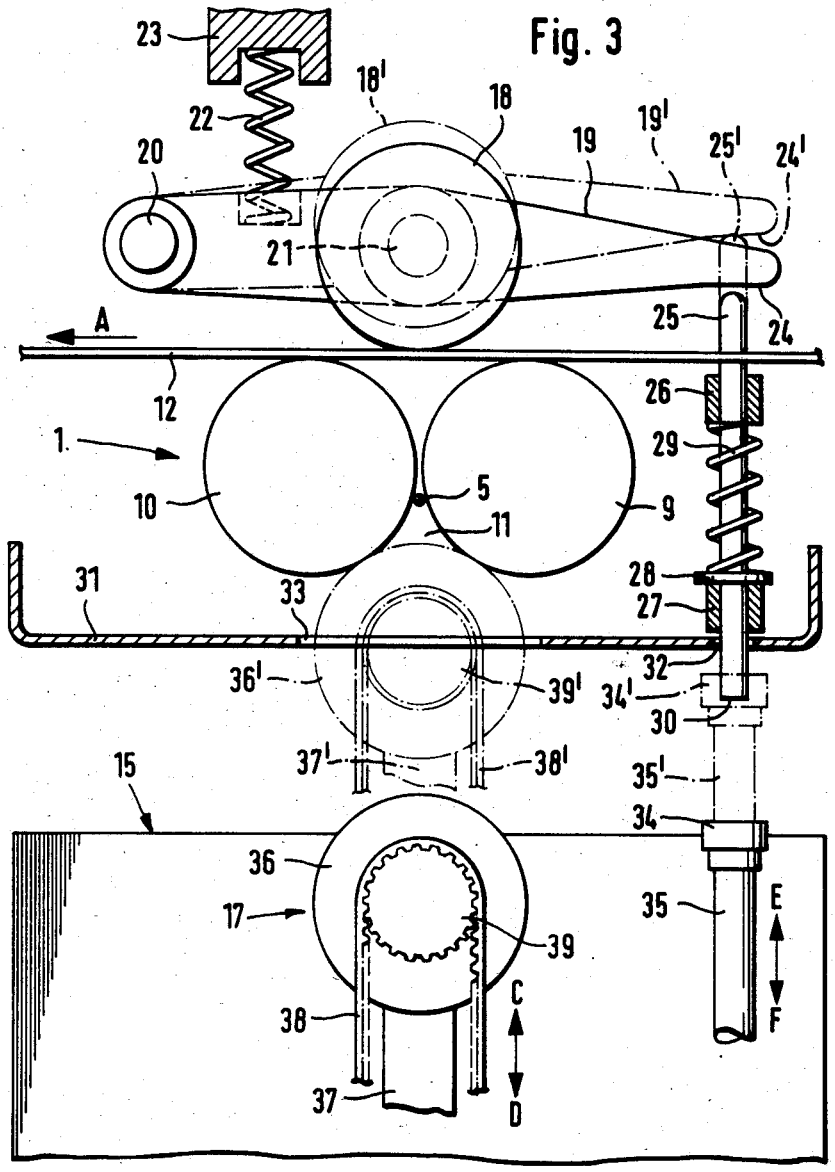
FIG. 3 is a top view of FIG. 2, schematically depicting two different operational conditions.

The invention will first be explained with reference to FIGS. 2 and 3 which show two different views of the same embodiment. In FIG. 2, the operational drive is interrupted, i.e. the driving tangential belt 12 is lifted off the rollers 9 and 10. In FIG. 3, on the other hand, two operating conditions are shown, where the dash-dotted variant of FIG. 3 corresponds to the condition shown in FIG. 2, while the solid line depiction of movable components of FIG. 3 mark the spinning operational condition during which the tangential belt 12 rests against the rollers 9 and 10.

The wedge-shaped gap 11 is only dash-dotted in FIG. 2 because only one of the two rollers 9 and 10 can be recognized in this view. The withdrawal direction of the spun yarn 5 has the letter B (see also FIG. 1).

In the operational condition, the tangential belt 12 runs along directly against the shell surfaces of the rollers 9 and 10. Belt 12 functions as a friction drive and, by means of devices of the servicing apparatus 15, can be selectively lifted off the shell surfaces of the rollers 9 and 10. The loading force for the tangential belt 12 is applied by a tension roll 18 located in the so-called wedge-shaped gap plane, i.e., in a plane that extends through the wedge-shaped gap 11 and vertically to the axes of the rollers 9, 10, and is aimed toward the wedge-shaped gap 11 so that only one tension roll 18 has to be assigned to two rollers 9 and 10. The tension roll 18 is located on a swivel lever 19 so that it can be freely rotated about a shaft 21 that extends in parallel to the wedge-shaped gap 11, said swivel lever 19 being pivotal about a stationary shaft 20 of the spinning unit 1 extending in parallel to the shaft 21. The direct pressing force is generated by a pressure spring 22 which, on the one side, supports itself against the swivel lever 19 and, on the other side, against a stationary holder 23. The tension roll 18, together with the swivel lever 19, can take up an inoperative position, in which case the tension roll will then take up position 18' and the swivel lever will take up position 19'. As shown in FIG. 2, the tangential belt which also in the operational condition is somewhat deflected, goes into position 12' in which it is lifted off the surfaces of the rollers 9 and 10.

For the lifting-off of the tension roll 18, the swivel lever 19 has a pressure surface 24, against which a tappet 25 can be pressed. Each spinning unit 1 contains such a tappet 25 which is guided in stationary slide bearings 26 and 27 and which, during operation, has no contact with the swivel lever 19, i.e., has a slight distance from the pressure surface 24 of the swivel lever 19. The tappet 25 has a pressure ring 28 which, in operational condition, namely when the tangential belt 12 runs along against the rollers 9 and 10, rests against one of the slide bearings 27. This takes place under the effect of a pressure spring 29 which, on the one side, supports itself against the ring 28, and on the other side, against the slide bearing 26. On its side facing away from the swivel lever 19, the tappet 25 has a contact surface 30 which can be actuated by the servicing apparatus 15.

On its side facing the servicing apparatus 15, the spinning unit 1 is covered with a cover 31. For the guiding-through of the tappet 25, a passage bore 32 is provided in the cover 31. In the area of the wedge-shaped gap 11 of the rollers 9 and 10, the cover 31 has another recess 33, through which an auxiliary drive 17 of the servicing apparatus 15 can be applied to the rollers 9 and 10.

The lifting of the tension roll 18 off the tangential belt 12 takes place by pressure against the contact surface 30 of the tappet 25 which then goes into position 25'. A thrust piece 34 of the servicing apparatus 15 is used for this purpose. The thrust piece 34 is mounted at a pressure rod 35 which, by means of devices that are not shown, can be adjusted corresponding to the directions of the arrows E and F. After the application of the contact surface 30, the thrust piece 34 takes up position 34' and the pressure rod 35 correspondingly has position 35'. Consequently, the drive of the rollers 9 and 10 is interrupted by the lifting off of the tension roll 18 from the tangential belt 12 into position 18'.

The servicing apparatus 15 contains a friction drive 17 which in the present embodiment has a friction wheel 36 which is rotatably arranged on a lever 37 which is movable in the directions of the arrows C and D to and away from the spinning unit 1. In this case, the friction wheel 36 can be applied to the surface of the rollers 9 and 10 through the recess 33 of the cover 31 and, if the operational drive is interrupted, can drive the rollers 9 and 10 in an auxiliary manner at a rotating speed that as a rule is reduced and deviates from the normal spinning operational rotating speed. The friction wheel 36 contains a toothed wheel 39 which, in a toothed belt 38 is driven by a continuously controllable electric motor. The toothed belt, corresponding to the directions of the arrows C and D, can be moved along with the lever 37. When the toothed belt 38 is stopped, the friction wheel 36 may act as a brake for the rollers 9 and 10. With its feeding force, the friction wheel 36 is also effective in the direction of the wedge-shaped gap 11 so that for the driving of the rollers 9 and 10 by the auxiliary drive of the servicing apparatus 15 also only one friction drive 17 is required.

Figure 4:
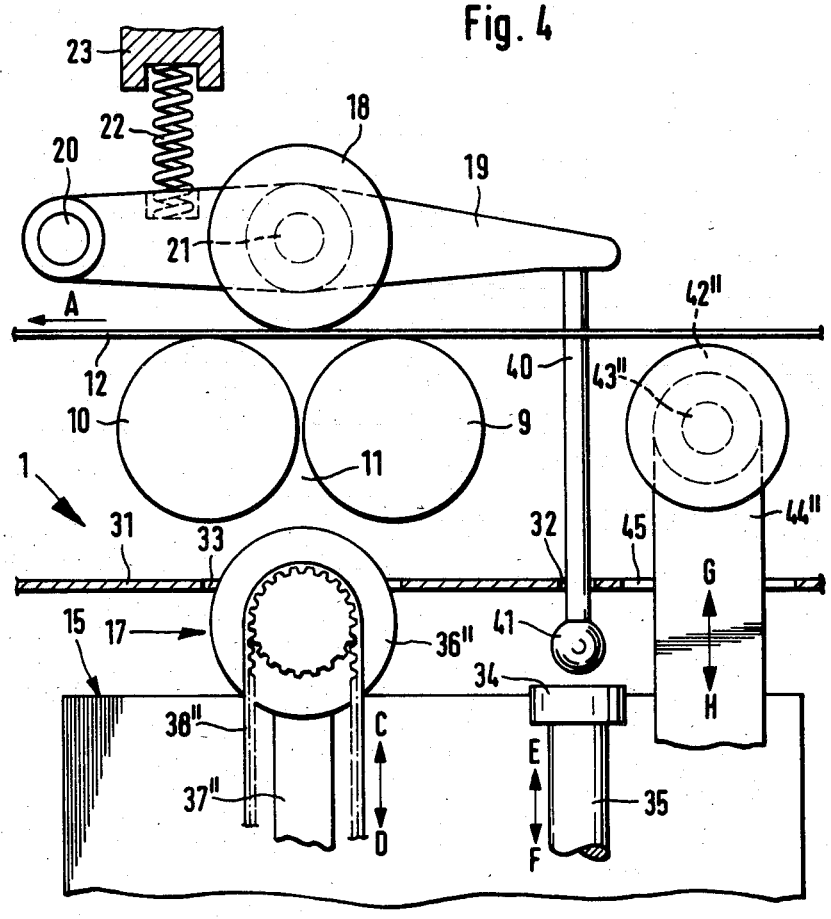
FIG. 4 is a view similar to FIG. 3, showing another preferred embodiment constructed according to the invention and having an additional belt lifting roll that can be applied by the servicing apparatus.

The embodiment according to FIG. 4 which is shown in the operational condition in which the rollers 9 and 10 are driven by the tangential belt 12, corresponds extensively to the embodiment according to FIGS. 2 and 3. The operation of the swivel lever 19 is modified as compared to the FIG. 2 embodiment to be connected firmly with an actuating rod 40. This actuating rod 40 has a spherical head 41 which can be actuated by the pressure piece 34 of the servicing apparatus 15 in the described manner. The application of the friction drive 17 of the servicing apparatus 15 also corresponds to the above-described embodiment.

The friction drive 17 is shown in FIG. 4 as not yet applied to the rollers 9 and 10 but already in an intermediate position in which it was placed at the recess 33 of the cover 31. Consequently, in this intermediate position, the friction wheel has the reference number 36'' and the lever has the reference number 37'' and the toothed belt has the reference number 38''.

Supplementary to the above-described embodiment of FIGS. 2 and 3, an additional lifting roll 42 is provided as a component of the servicing apparatus 15. The lifting roll 42 in the representation of FIG. 4 has already been moved into an intermediate position 42''. It is rotatably disposed on a shaft 43'' which itself is attached at a lever 44'' of the servicing apparatus 15. The lever 44'' can be moved corresponding to the directions of the arrows G and H. For the application of the lifting roll 42'', the cover 31 has an additional recess 45.

The embodiment according to FIG. 4 has the advantage that for the interruption of the operational drive, not only the tension roll 18 is lifted off the tangential belt 12, but in addition, the lifting roll 42'' is applied to the tangential belt 12, so that the tangential belt 12 is also lifted securely off the rollers 9 and 10 and is not only relaxed. The embodiment according to FIG. 4 has the advantage that for all spinning units 1 only one single lifting roller 42 has to be provided.

Figure 5:
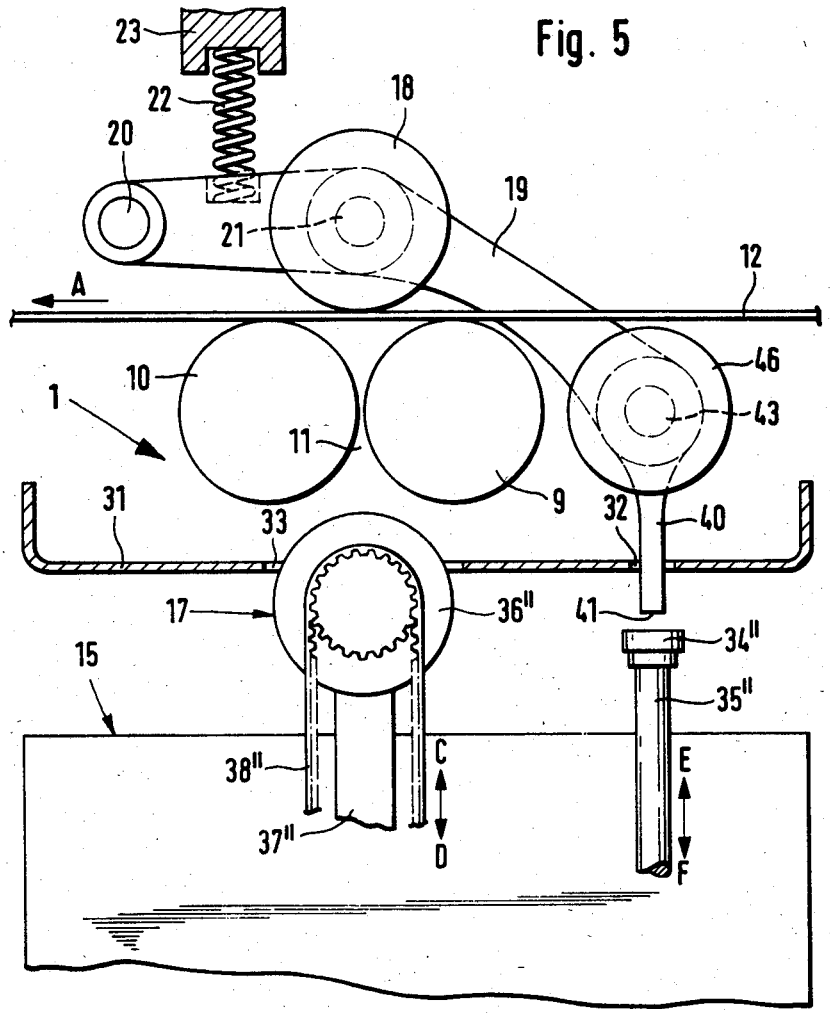
FIG. 5 is a view similar to FIG. 4, showing another preferred embodiment constructed according to the invention where the belt lifting roll is assigned to the spinning unit but can be actuated by the servicing apparatus.

The embodiment according to FIG. 5 differs from the embodiment according to FIG. 4 essentially only because of the fact that the roll 46 provided as the lifting roll is rotatably disposed on a shaft 43 of the swivel lever 19. Therefore, each spinning unit 1 has its own lifting roll 46. FIG. 5 shows the operational condition where the tangential belt 12 drives the rollers 9 and 10, but where the friction drive 17 of the servicing apparatus 15 and the pressure rod 35 of the servicing apparatus 15 have been brought into the intermediate position 35'' so that the process is already started of lifting the tension roll 18 off the tangential belt 12 and of applying the friction drive 17 to the rollers 9 and 10. The thrust piece located in position 34'' can be applied to the contact surface 41 of a continuation 40 of the swivel lever 19, by means of which, in addition to the lifting of the tension roll 18 from the tangential belt 12, the lifting roll 46 is also applied to the tangential belt 12 so that this belt 12 is lifted off the drive surfaces of the rollers 9 and 10.

Figure 6:
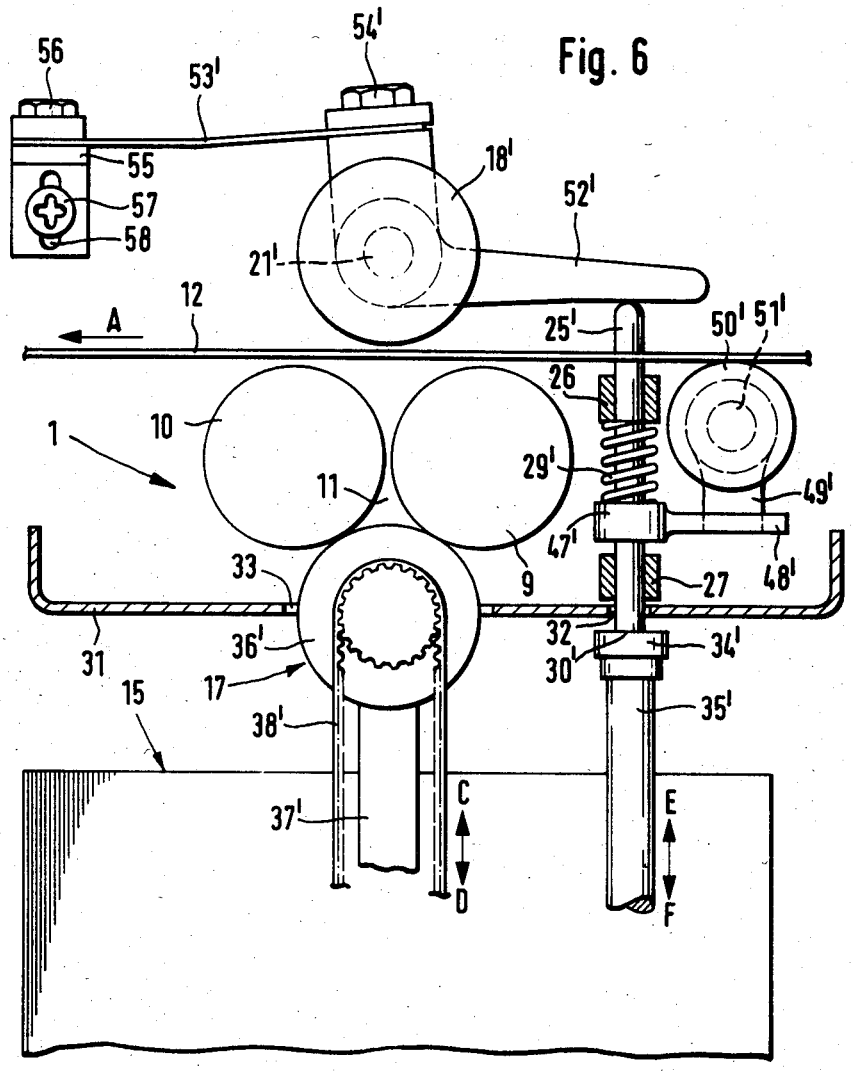
FIG. 6 is a view similar to FIG. 5, showing another preferred embodiment constructed according to the invention and where the operational tension roll is held by a leaf spring.

In the case of the embodiment according to FIG. 6, the operational drive of the rollers 9 and 10 is interrupted, while the auxiliary devices of the servicing apparatus 15 are assigned to the spinning unit 1 so that the momentary position of the concerned components has one apostrophe 1.

The lifted off tension roll 18' of FIG. 6 can be freely rotated on a shaft 21' of the toggle lever 52'. The toggle lever 52', by means of a screw 54', is mounted at a very wide leaf spring 53' which is provided instead of the swivel lever 19 described in the previous embodiments. The leaf spring 53' is mounted at a stationary holder 55 by means of a screw 56. The holder 55 has an oblong hole 58 so that, by means of a screw 57, it can be adjusted corresponding to the desired pressure of the tension roll 18. The load force applied by the tension roll 18 is directed toward the wedge-shaped gap 11 of the rollers 9 and 10.

Through the recess 33 of the cover 31, the friction wheel 36' of the servicing apparatus 15 has in the meantime been applied to the rollers 9 and 10 so that these are, temporarily driven at a speed that deviates from the normal spinning operational speed. The thrust piece 34' of the pressure rod 35' was applied to the contact surface 30' of the tappet 25'. As mentioned in connection with FIG. 3, the tappet 25' is guided in stationary slide bearings 26 and 27. In the normal operating condition, when the tangential belt 12 runs along against the shell surfaces of the rollers 9 and 10, the tappet 25 does not touch the toggle lever 52. This is caused by a pressure spring 29' which, by means of a ring collar 47' connected with the tappet 25', tends to push against the slide bearing 27. At the other front end, the pressure spring 29' supports itself at the slide bearing 26.

A bracket 48' is connected with the ring collar 47', a holder 49' for a belt lifting roll 50' being fastened at said bracket 48', said belt lifting roll 50' being disposed so that it can be rotated around shaft 51' of the holder 49'. The belt lifting roll 50' therefore exists in each single spinning unit 1 and is mounted directly at the tappet 25'.

Figure 7:
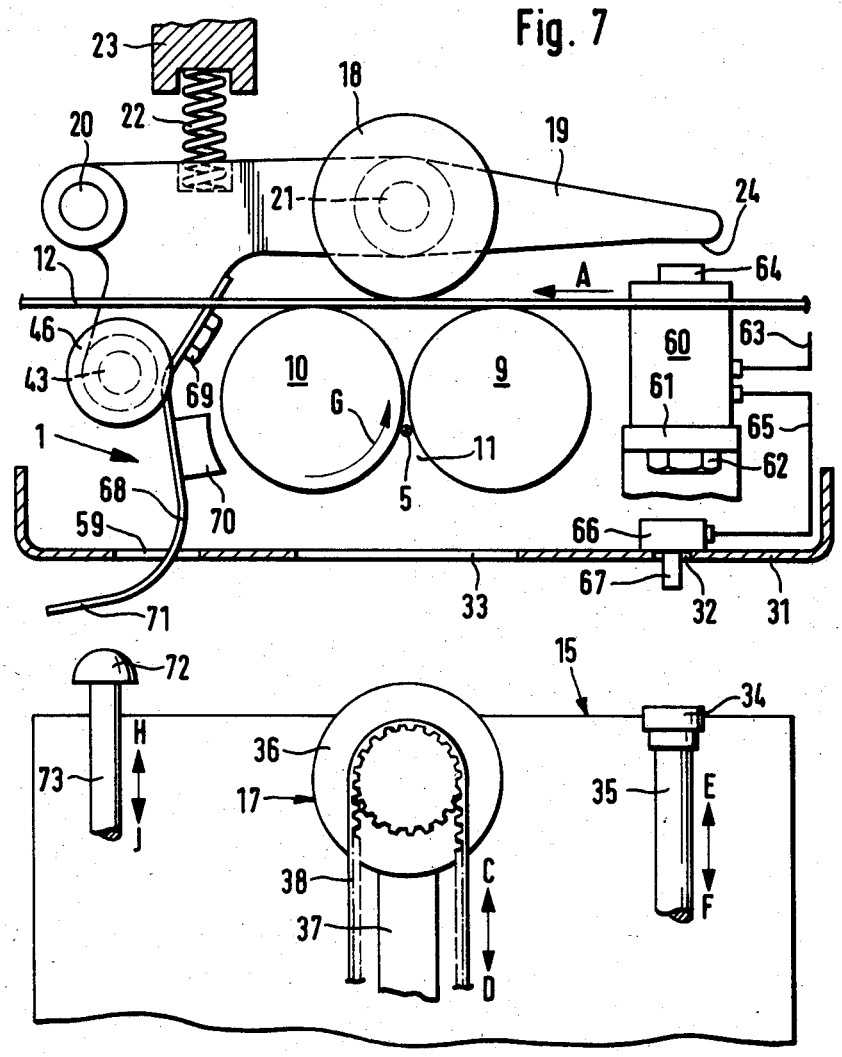
FIG. 7 is a view similar to FIG. 5, showing another preferred embodiment constructed according to the invention and where each spinning point is assigned an electromagnet that responds at the time of a yarn breakage for interrupting the drive.

FIG. 7 shows an embodiment where the operational drive is automatically interrupted in the case of yarn breakage. The operating condition is shown where the devices of the servicing apparatus 15 are still in waiting position, so that the respective reference numbers have no index (are not primed or double primed).

The tangential belt 12 drives the rollers 9 and 10, where the load force is again caused by a tension roll 18 pressing toward the wedge-shaped gap 11. This pressure force is again caused by the pressure spring 22 which supports itself on one side against the swivel lever 19 and, on the other side, against a stationary holder 23. The swivel lever 19 can be swivelled around a stationary shaft 20 and, on another lever arm, has a belt lifting roll 46 which can be rotated freely around a shaft 43 of the swivel lever 19.

An electromagnet 60 is assigned to each spinning unit 1, said electromagnet 60, via a line 63, being connected with the yarn monitor that is not shown and is assigned to each spinning unit 1 (compare yarn monitor 13 of FIG. 1). The electromagnet 60 contains a piston 64 which, in the case of a yarn breakage, when the electromagnet 60 is energized, moves out by a certain amount and, in the process can place itself against a contact surface 24 of the swivel lever 19, lifting the swivel lever 19 slightly. As a result, on the one hand, the tension roll 18, lifts off the tangential belt 12, while, on the other hand, the belt lifting roll 46 is applied to the tangential belt 12 so that this belt 12 itself lifts off the drive surfaces of the rollers 9 and 10. In this way, in the case of a yarn breakage, the rollers 9 and 10 may be stopped also without the participation of the servicing apparatus 15, so that any fibers that may still reach the wedge-shaped gap 11, are not twisted together. Since in the case of yarn breakage, there is no withdrawal of a yarn 5, a twisting of residual fibers in the wedge-shaped gap 11 could be very damaging.

Via another line 65, the electromagnet 60 is connected with a switch 66, the pusher 67 of which protrudes through an opening 32 of the covering 31 from the spinning unit 1. The thrust piece 34 of the pressure rod 35 of the servicing apparatus 15 can rest against this pusher 67, so that the electromagnet 60 can be switched also by the servicing apparatus 15.

Through the recess 33 of the covering 31, in a manner that was described, the friction wheel 36 of the friction drive 17 can selectively be applied to the rollers 9 and 10.

As explained, the roller 10 turning into the wedge-shaped gap 11 corresponding to the direction of the arrow G is particularly important in the case of a yarn breakage, because generally this roller 10 transports possible residual fibers into the wedge-shaped gap 11. For this reason, it is advantageous if, in the case of yarn breakage, especially roller 10 is stopped rapidly. A leaf spring 68 is therefore mounted at the swivel lever 19 by means of a screw 69, said leaf spring 68, when the swivel lever 19 swings around the shaft 20, swivelling along and in the process being able to press a brake 70 against the shell surface of the roller 10. As a result, at least the roller 10 is stopped fast. As a supplement, a similar brake may naturally also be provided for roller 9.

When the friction drive 17 is applied, it is useful that the brake 70 can be detached from the roller 10, without, however, applying the tension roll 18 to the tangential belt 12. Because of the fact that the brake 70 is mounted at a flexible leaf spring 68, by means of a tappet 72 of the servicing apparatus 15, the leaf spring 68 can be moved around its point of fixation which is represented by the screw 69. As a result, despite the fact that the tangential belt 12 is lifted off the rollers 9 and 10, the brake 70 can be detached from the roller 10. In order to be actuated, the leaf spring 68 has an extension 71 protruding from a recess 59 of the covering 31. The tappet 72 is fastened at a pressure rod 73 which can be adjusted corresponding to the directions of the arrows H and I.

Figure 8:
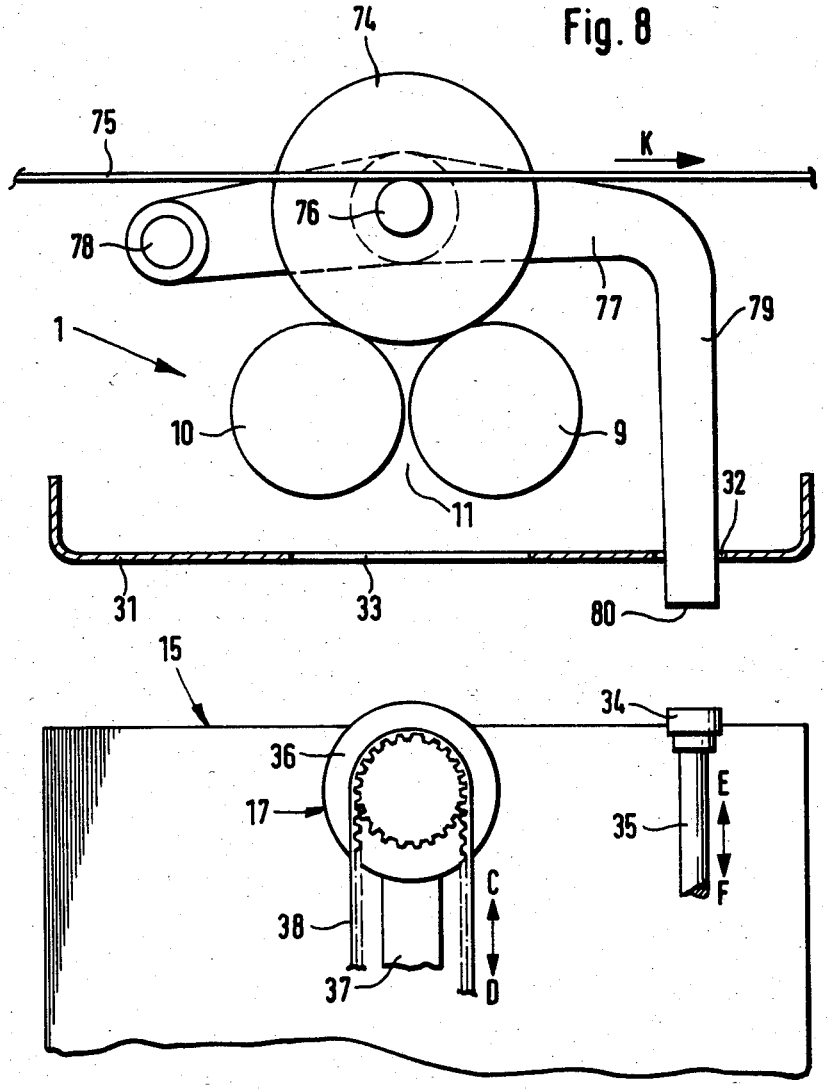
FIG. 8 is a view similar to FIG. 3, showing another preferred embodiment constructed according to the invention and having a friction wheel drive for the operational condition.

The embodiment according to FIG. 8 differs from all the other previously described embodiments mainly because of the fact that the rollers 9 and 10 during normal spinning operation are driven by a friction wheel 74, the load force of which affects the wedge-shaped gap 11. The friction wheel 74 can be rotated freely around a shaft 76, said shaft 76 being mounted on a swivel lever 77 which can be swivelled around a stationary shaft 78 of the spinning unit 1. The shaft 76 of the friction wheel 74 is driven by a tangential belt 75 corresponding to the direction of the arrow K, so that the rollers 9 and 10 have the same rotational direction as the rollers of the previously described embodiments. The swivel lever 77, with an extension 79, projects through an opening 32 of the cover 31 from the spinning unit 1. The contact surface 80 of the extension of the swivel lever 77 can again be applied to the thrust piece 34 mount at the pressure rod 35 of the servicing apparatus 15.

The friction drive 17 assigned to the servicing apparatus 15 is illustrated in FIG. 8 in its waiting position and can, as in the previously described embodiments, be selectively applied to the surfaces of the rollers 9 and 10 through the recess 33 of the cover 31.

Figure 9:
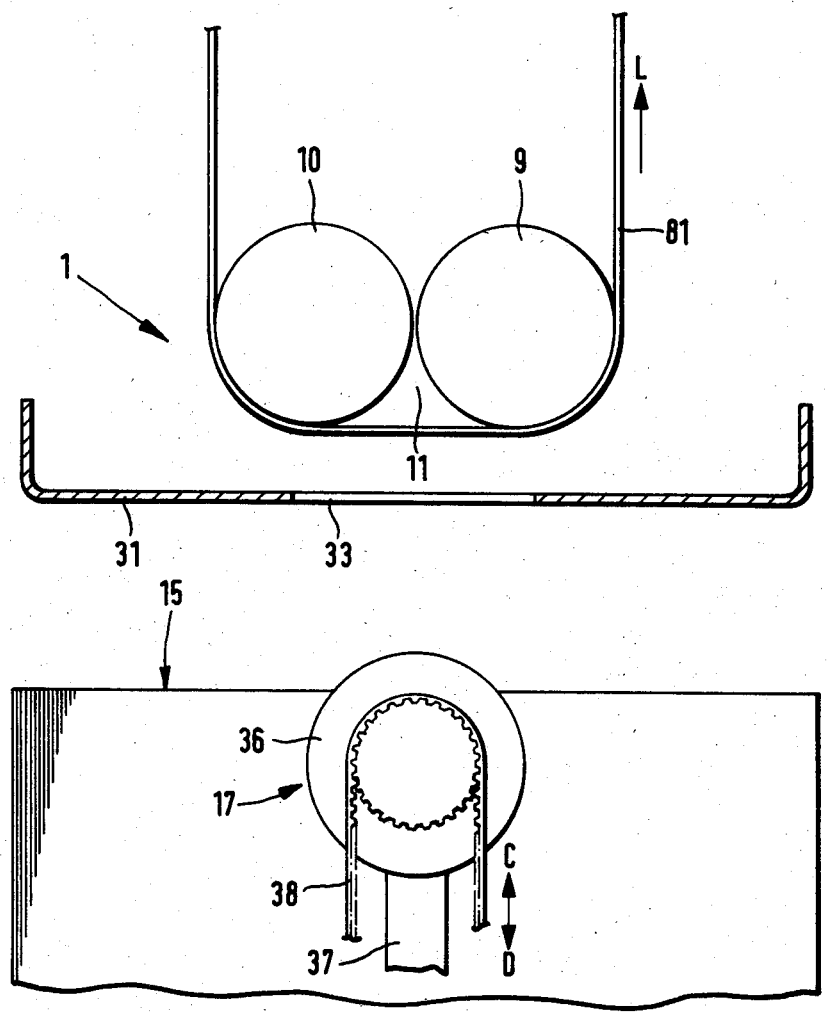
FIG. 9 is a view similar to FIG. 3, showing another preferred embodiment constructed according to the invention and having a single belt drive for the rollers.

In the case of the embodiment according to FIG. 9, the rollers 9 and 10 are driven by a driving belt 81 which rotates according to the direction of the arrow L, in which case the deflection pulleys and the driving roll for the individual belt 81 are not shown. By means of the type of selected looping, the load force of the individual belt 81 presses toward the wedge-shaped gap 11. In this type of drive, a very narrow individual belt 81 may be used so that there is sufficient space to apply, in addition to the individual belt 81, also the friction wheel 36 of the servicing apparatus 15 to the shell surfaces of the rollers 9 and 10.

As is sufficiently known from belt drives of ring spindles, it is not required, during the braking of the rollers 9 and 10, to lift the individual belt 81 off the surface of the rollers 9 and 10. The braking can be caused by the application of the friction wheel 36 to the surfaces of the rollers 9 and 10, in which case the toothed belt 38 driving the friction wheel 36 will then be stopped. Also, the pressing force of the friction wheel 36 may be selected to be so strong that the drive of the friction wheel 36 predominates in comparison to the drive of the individual belt 81, so that the rollers 9 and 10 may temporarily be driven by the friction drive 17 at a reduced speed.

Figure 10:
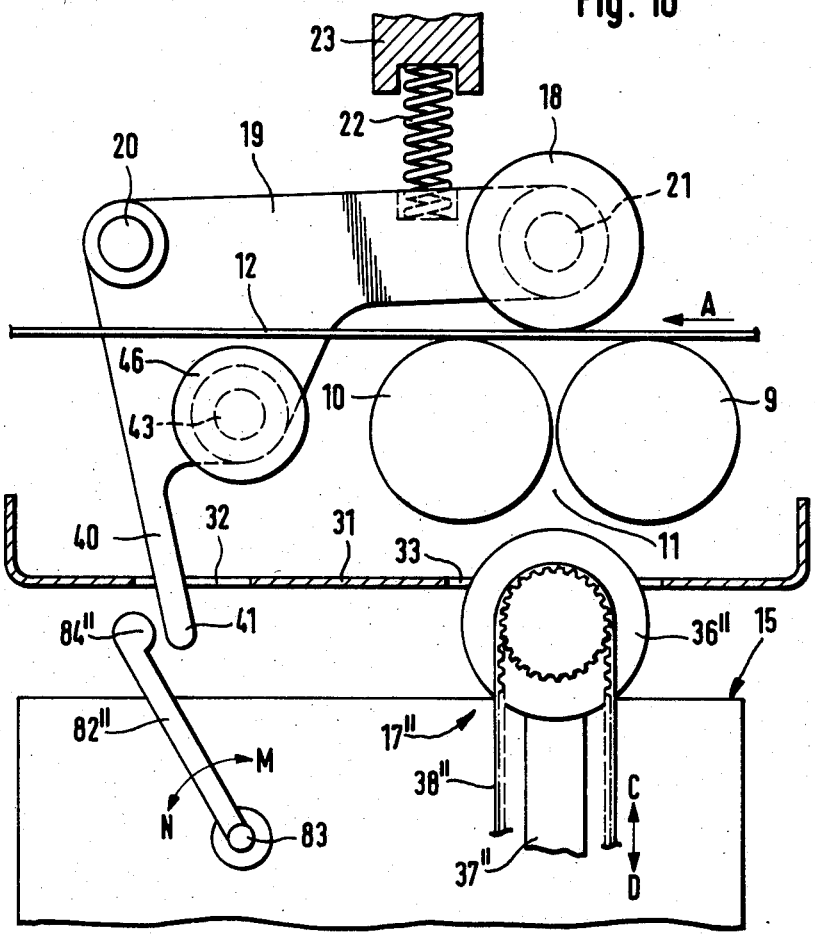
FIG. 10 is a view similar to FIG. 5, showing yet another preferred embodiment of the invention.

In the case of the embodiment according to FIG. 10, an operational drive in the form of a tangential belt 12 is again provided which passes through in longitudinal direction of the machine and drives all rollers 9, 10 of the individual spinning units 1. The tangential belt 12 is tensioned by means of a tension roll 18 that can be applied to the tangential belt 12 in the plane of the wedge-shaped gap, said tension roll 18 being disposed on a swivel lever 19 loaded by a pressure spring 22 supporting itself at a stationary holder 23. In addition to the rollers 9 and 10, a lifting roll 46 is disposed at the swivel lever 19, said lifting roll 46, which rests against the tangential belt 12 and lifts this belt 12 off the shell surfaces of the rollers 9, 10 when the tension roll 18 is swivelled away from the side of the rollers 9, 10.

The servicing apparatus of the embodiment according to FIG. 10 is provided with an auxiliary drive 17 containing a friction wheel 36" which, in the area of the wedge-shaped gap 11, can be applied between the two rollers 9 and 10. The servicing apparatus 15 is also connected with an adjusting lever 82" that can be swivelled around a shaft 83 by means of an actuating drive, said adjusting lever 82" at its end, being provided with a button-type thickening 84" by means of which it can place itself against a stop face 41 of an arm 40 of the swivel lever 19.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An open-end friction spinning machine comprising:

a plurality of adjacently arranged spinning units, each spinning unit including a pair of friction rollers with cylindrical outer surfaces disposed adjacent one another to form a yarn forming wedge-shaped gap therebetween, common driving means for driving the friction rollers of at least one of the spinning units, and servicing means selectively operable at respective spinning units to perform servicing operations, said servicing means including auxiliary drive means for driving the friction rollers of a spinning unit during servicing operations, said auxiliary drive means including an auxiliary drive element directly engageable simultaneously with said outer surfaces of both friction rollers of a respective spinning unit, said common driving means having a joint drive element which runs simultaneously against the shell surfaces of both friction rollers of the respective spinning units, said joint drive element comprising a tangential belt passing through in longitudinal direction of the spinning machine resting against the shell surfaces of both friction rollers of respective spinning units and which, at each spinning unit, is loaded in the direction of the shell surfaces of the friction rollers by means of a tension roll arranged in the plane of the wedge-shaped gap, said servicing means being part of a mobile servicing unit which is selectively movable between spinning units, said auxiliary drive element being carried with the mobile servicing unit, and wherein each spinning unit is provided with a lever mechanism affecting the holding of the tension roll, and the mobile servicing unit is provided with an actuating element for this lever mechanism.

2. An open-end friction spinning machine comprising:

a plurality of adjacently arranged spinning units, each spinning unit including a pair of friction rollers with cylindrical outer surfaces disposed adjacent one another to form a yarn forming wedge-shaped gap therebetween, common driving means for driving the friction rollers of at least one of the spinning units, and servicing means selectively operable at respective spinning units to perform servicing operations, said servicing means including auxiliary drive means for driving the friction rollers of a spinning unit during servicing operations, said auxiliary drive means including an auxiliary drive element engageable simultaneously with both friction rollers of a respective spinning unit, said common driving means having a joint drive element which runs simultaneously against the surfaces of both fricition rollers of the respective spinning units, said joint drive element comprising a tangential belt passing through in a longitudinal direction of the spinning machine resting against the surfaces of both friction rollers of respective spinning units and which, at each spinning unit, is loaded in the direction of the surfaces of the friction rollers by means of a tension roll arranged in the plane of the wedge-shaped gap, said servicing means being part of a mobile servicing unit which is selectively movable between spinning units, said auxiliary drive element being carried with the mobile servicing unit, and wherein each spinning unit is provided with a lever mechanism affecting the holding of the tension roll, and the mobile servicing unit is provided with an actuating element for this lever mechanism, said tangential belt and the tension roll being arranged on a side of the friction rollers that faces away from the wedge-shaped gap.

3. An open-end friction spinning machine comprising:

a plurality of adjacently arranged spinning units, each spinning unit including a pair of friction rollers with cylindrical outer surfaces disposed adjacent one another to form a yarn forming wedge-shaped gap therebetween, common driving means for driving the friction rollers of at least one of the spinning units, and servicing means selectively operable at respective spinning units to perform servicing operations, said servicing means including auxiliary drive means for driving the friction rollers of a spinning unit during servicing operations, said auxiliary drive means including an auxiliary drive element engageable simultaneously with said outer surfaces of both friction rollers of a respective spinning unit, said common driving means having a joint drive element which runs simultaneously against the surfaces of both friction rollers of the respective spinning units, said joint drive element comprising a tangential belt passing through in a longitudinal direction of the spinning machine resting against the surfaces of both friction rollers of respective spinning units and which, at each spinning unit, is loaded in the direction of the surfaces of the friction rollers by means of a tension roll arranged in the plane of the wedge-shaped gap, said tension roll being arranged on a spring-loaded swivel lever.

4. An open-end friction spinning machine according to claim 3, wherein the swivel lever is provided with a lifting roll which, with respect to the tangential belt is arranged on the side of the friction rollers laterally adjacent to the friction rollers.

5. An open-end friction spinning machine according to claim 3, wherein at least one brake lining held by a spring is mounted at the swivel lever, said brake lining being engageable against the shell surface of one friction roller when the tension roll is in a non-contact position relative to the tangential belt.

* * * * *